US007662036B2

(12) United States Patent
Mhatre

(10) Patent No.: US 7,662,036 B2
(45) Date of Patent: Feb. 16, 2010

(54) 3-CONE DIFFUSER

(76) Inventor: Ramesh Nana Mhatre, B-701 Centre Point, Panch Pakhadi, Thane, Maharashtra (IN) 400 602

( * ) Notice: Subject to any disclaimer, the term of this patent is extended or adjusted under 35 U.S.C. 154(b) by 782 days.

(21) Appl. No.: 10/535,847

(22) PCT Filed: Oct. 7, 2002

(86) PCT No.: PCT/IN02/00201

§ 371 (c)(1),
(2), (4) Date: May 20, 2005

(87) PCT Pub. No.: WO2004/031662

PCT Pub. Date: Apr. 15, 2004

(65) Prior Publication Data

US 2006/0194534 A1 Aug. 31, 2006

(51) Int. Cl.
*F24F 13/08* (2006.01)

(52) U.S. Cl. ..... 454/300; 454/310; 454/311; 454/312

(58) Field of Classification Search ..... 454/299, 454/300

See application file for complete search history.

(56) References Cited

U.S. PATENT DOCUMENTS 2,891,461 A 6/1959 O'Day
2,994,259 A 8/1961 O'Day
5,297,326 A * 3/1994 Kline ..... 29/401.1
5,658,196 A * 8/1997 Swaim ..... 454/300
6,817,941 B1 * 11/2004 Gatov ..... 454/187

FOREIGN PATENT DOCUMENTS

GB 876625 9/1961

* cited by examiner

*Primary Examiner*—Steve McAllister
*Assistant Examiner*—Helena Kosanovic
(74) *Attorney, Agent, or Firm*—Bacon & Thomas, PLLC

(57) ABSTRACT

3-Cone Diffuser including a central cone (1), an intermediate cone (2) and outer cone or outer frame (3) placed one above the other in a spaced apart relationships having same vertical axis (14). The central cone (1) at the back is provided with bracket (8) spot welded or brazed or rivetted directly or via an intermediate plate to the central cone to hold the centre cone which is fixed on the intermediate cone with the central opening (15) having outwardly projected flanges (16) having holes (17) to accommodate the front (18) and back (19) support of the bracket. The back support is provided with springs (9) for easy removal of the bracket, thereby enabling dismantling the central cone easily. The intermediate cone (2) on its outer flanges of the central opening (15), provided with pipe/rod (6) with spring (7) welded or brazed so as to fix the intermediate cone on the brackets (5) provided in the inner part of the outer cone enabling dismantling the intermediate cone by a slight pressing of the biasing spring (7). The outer cone (3) has a central inlet (20) with flanged portion outwardly directed (4) to connect with the ducting or damper. The inlet is adjustable as per the requirement of the ducting and the central cone is further provided with a hole (10) to adjust the aperture of the damper.

14 Claims, 8 Drawing Sheets

3-CONE DIFFUSER

BACKGROUND OF THE INVENTION

A. Field

The invention relates to Air Diffuser used in the air conditioning system. More particularly an air diffuser having multiple cones which can be fitted or dismantle easily in the air ducting arrangement.

B. Related Art

The conventional air diffusers are difficult to be fitted with the air ducting installation and dismantling is difficult requires lot of man power and downtime.

Therefore there is a need to develop an air diffuser which can fitted or dismantle easily and is suited to any shape or size of air ducting arrangement.

The primary object of this invention is to provide an air diffuser with multiple cones which is easy to be fitted or dismantle with any type of air ducting arrangements.

The another object of this invention is to provide single piece cone fitted one above the other with fitting arrangement which is fitted with the air ducting arrangement easily and dismantling like way are easy.

The still another object of this invention is to provide fitting arrangement which is simple and easy to manipulate.

SUMMARY OF THE DISCLOSURE

Accordingly there is provided a new three cone air diffuser made up of normally in Steel or Aluminium comprising of a Central Plate or Central Cone, Intermediate Cone and an Outer frame which is fitted with each other by means of at least a pair of spring loaded pipes fitted to each cone and facilitating easy removal of each cone from each other.

The Outer frame (3) made out of a piece of sheet, generally Aluminium or Steel framed with a flanged neck at the centre with variable hole size to fit different sizes of ducts inlet, normally circular but can be square or other shape as matching with the duct contains or more straps for fixing of the spring loaded pipes/rods of bell shaped construction on the back of the inner cone assembly comprising of inner cone and the centre cone.

The cone assembly comprising of inner cone(s) and central cone fitted with each other by spring loaded assembly.

The central cone made up of single sheet attached with a bracket to hold the inner cone fitted by means of welding, spot welding, brazing or riveting with or without in-between plate for extra strength or by any other means of fixing purpose of holding the centre cone from the intermediate cone at a particular distance, generally fixed but can be made variable by adjusting the height of the bracket, spring loaded to hold in the place bracket, spring loaded to hold in the same place to make able to remove the assembly when required quickly and easily. The outer frame (3) of the diffuser has a neck on the backside generally round in shape with a vertical collar (4), which fixes with the opening of the duct. From the vertical collar, the outer extends horizontally and then forming a bell like shape and then having a horizontal flat flange at the earlier edge. The outer edge is generally in square shape but can be blended to form different shapes like square or others. The flat surface of the outer frame containing one or more pains of projections which can be used as an additional support to the diffuser for having to the duct or ceiling. It also comprises at least a pair of slots (12), which are used for fixing brackets (5) for fixing of inner cone assembly.

The intermediate cone is made up of sheet of required size, normally Aluminium of Steel is having an opening, generally square or round at the centre, again a bell shaped structure but with lesser angle than the outer frame and a flat edge outwardly projected at the outer side of the opening which is generally of square shape. It contains at least two pairs of slots for fixing of the centre cone to form the cone assembly.

BRIEF DESCRIPTION OF THE DRAWINGS

The invention will now be described with reference to FIGS. 1 to 13 in the accompanying drawings.

DETAILED DESCRIPTION OF PREFERRED EMBODIMENTS OF THE INVENTION

Figure 1:
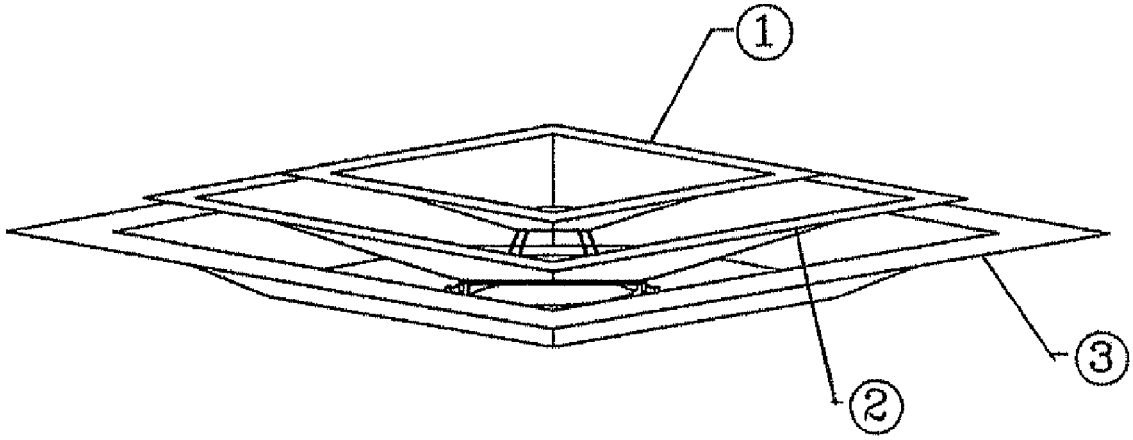
FIG. 1 is the elevation of the New 3-Cone Diffuser.
Figure 2:
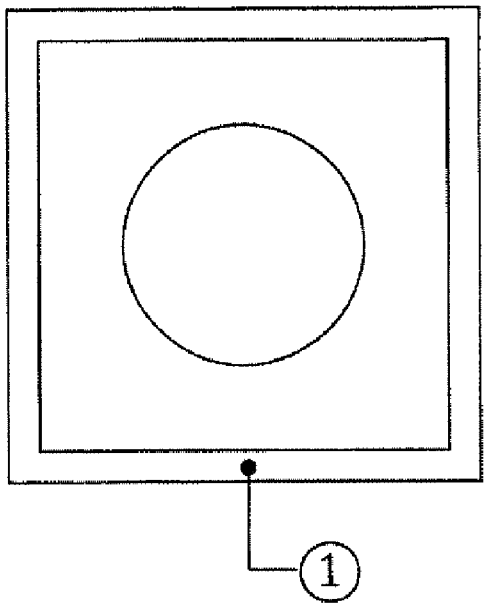
FIG. 2 is the top view of the front side of the central cone of air diffuser.
Figure 3:
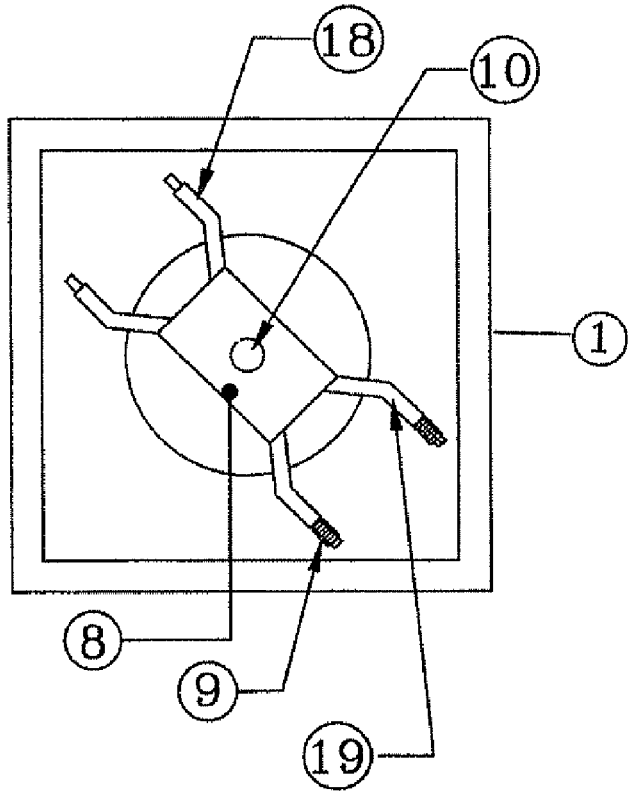
FIG. 3 is the top view of the back side of the front central cone showing the bracket spot-welded on the back of central cone which is used to assemble intermediate cone with the central cone.
Figure 4:
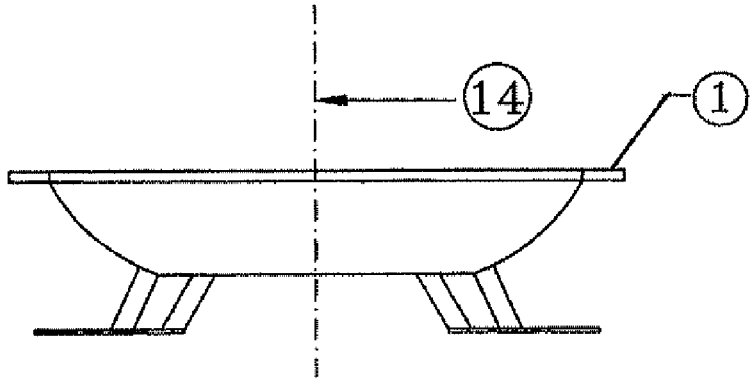
FIG. 4 is the side view of the central cone.
Figure 5:
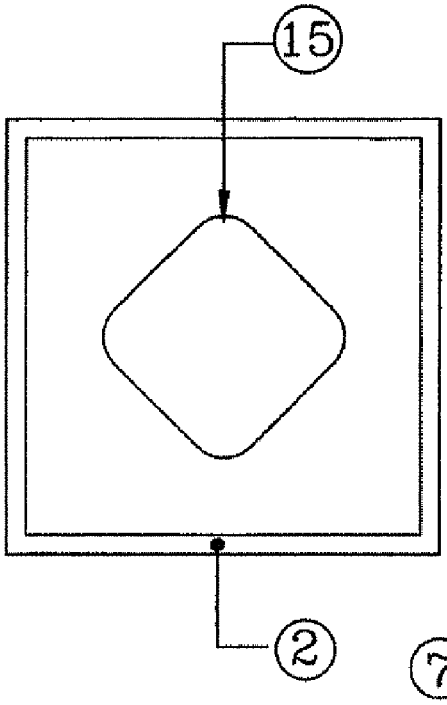
FIG. 5 is the top view of the front side of the intermediate cone of the air diffuser.
Figure 6:
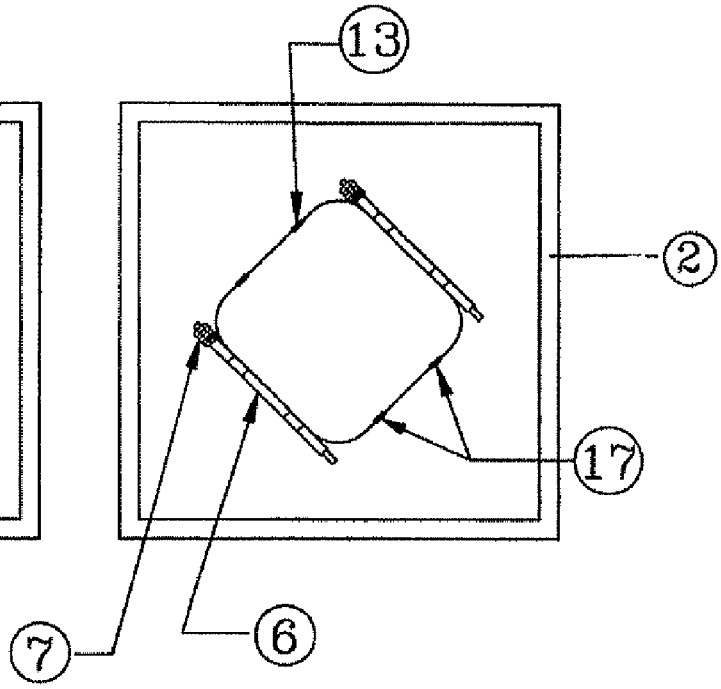
FIG. 6 is the top view of the backside of intermediate cone of the air diffuser.
Figure 7:
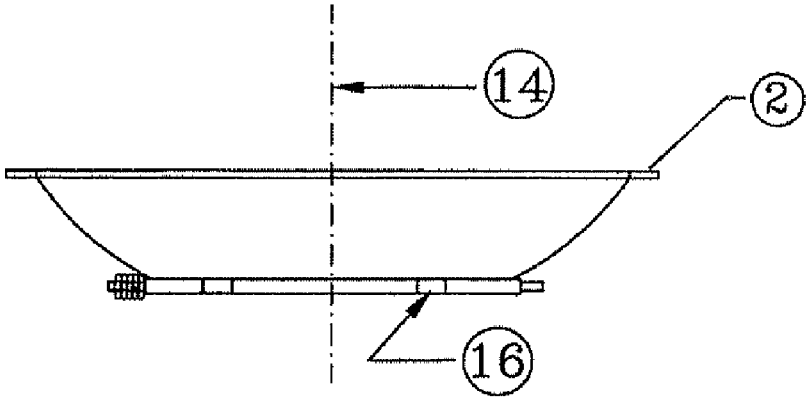
FIG. 7 is the side view of the intermediate cone.
Figure 8:
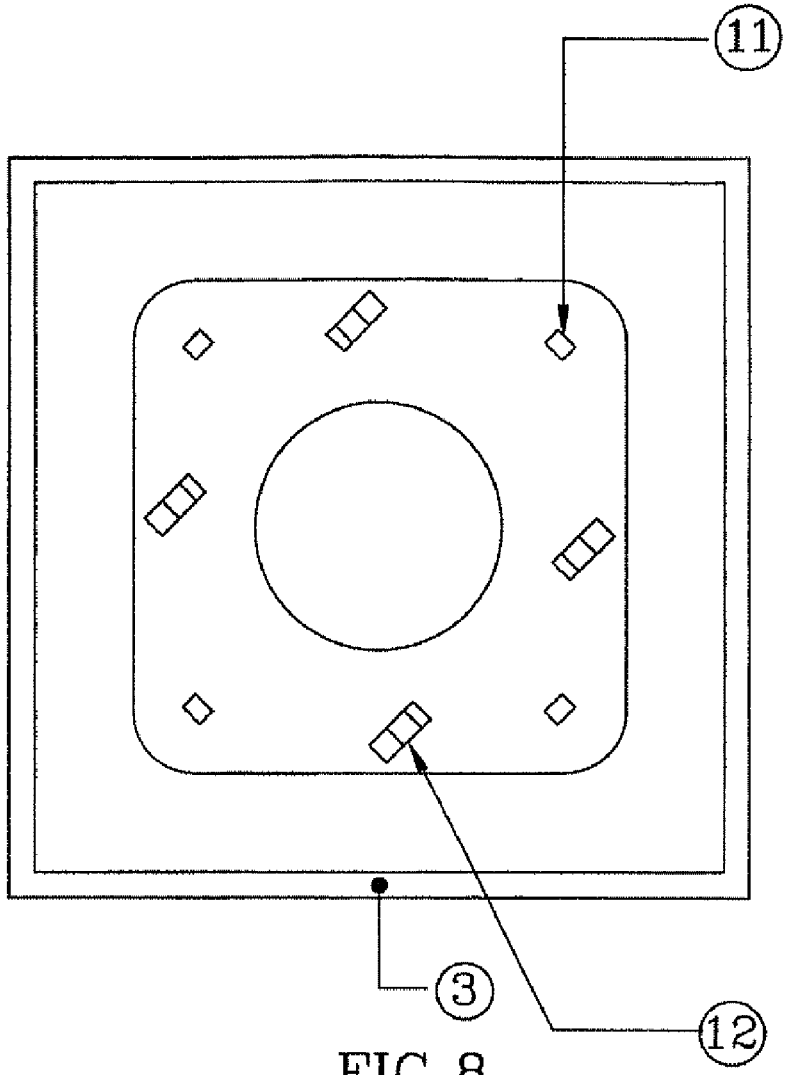
FIG. 8 is the plan view of the backside of outer cone of air diffuser.
Figure 9:
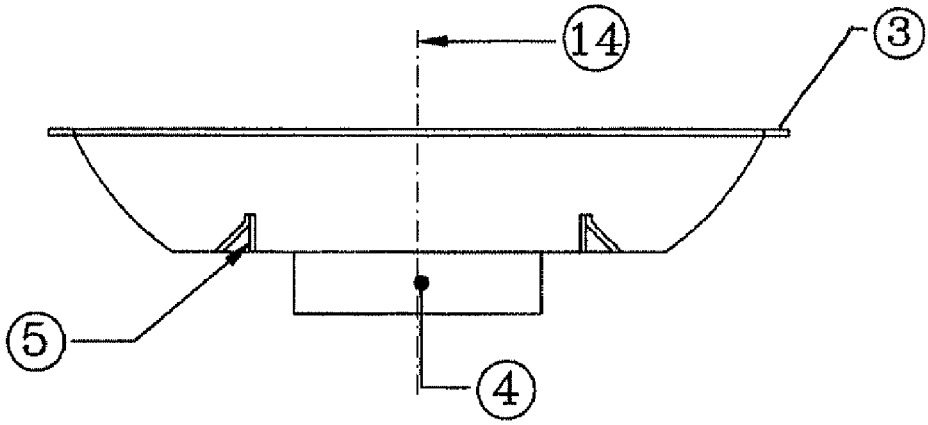
FIG. 9 is the side view of the outer cone of air diffuser.
Figure 10:
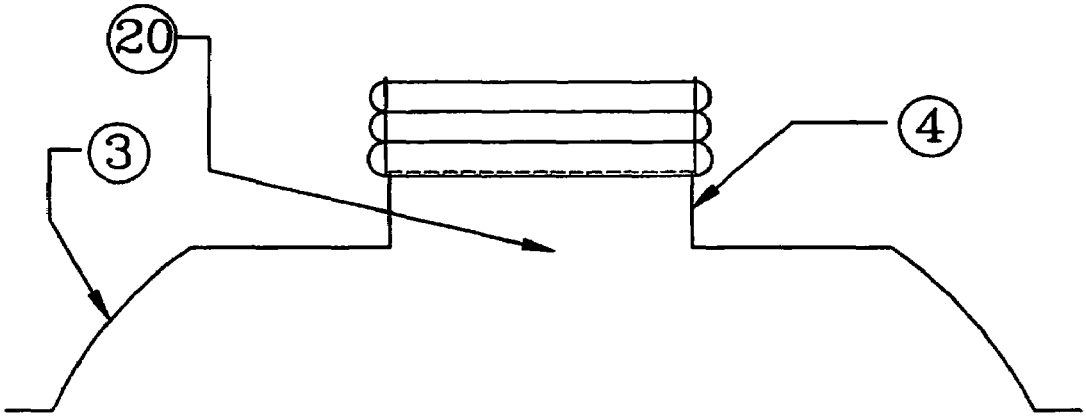
FIG. 10 is the elevation of the outer frame with general duct outlet fixed to its neck
Figure 11:
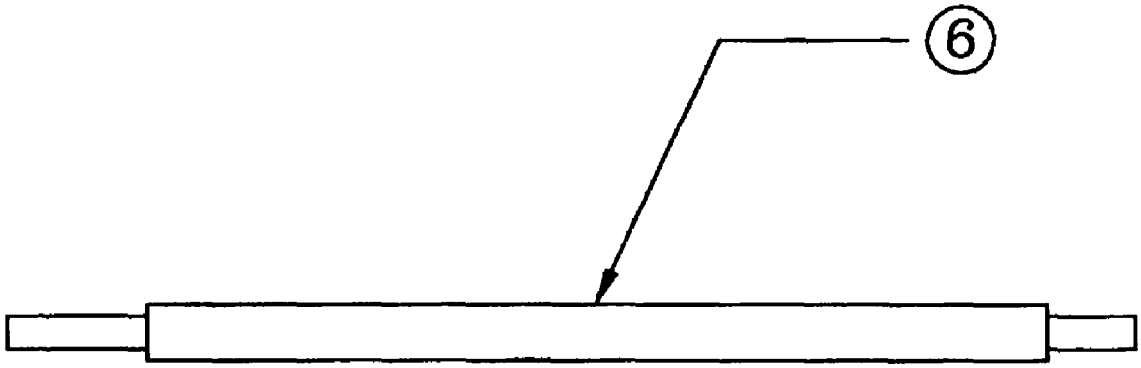
FIG. 11 is the elevation of the pipe/rod, which fits into bracket of bell shaped construction
Figure 12:
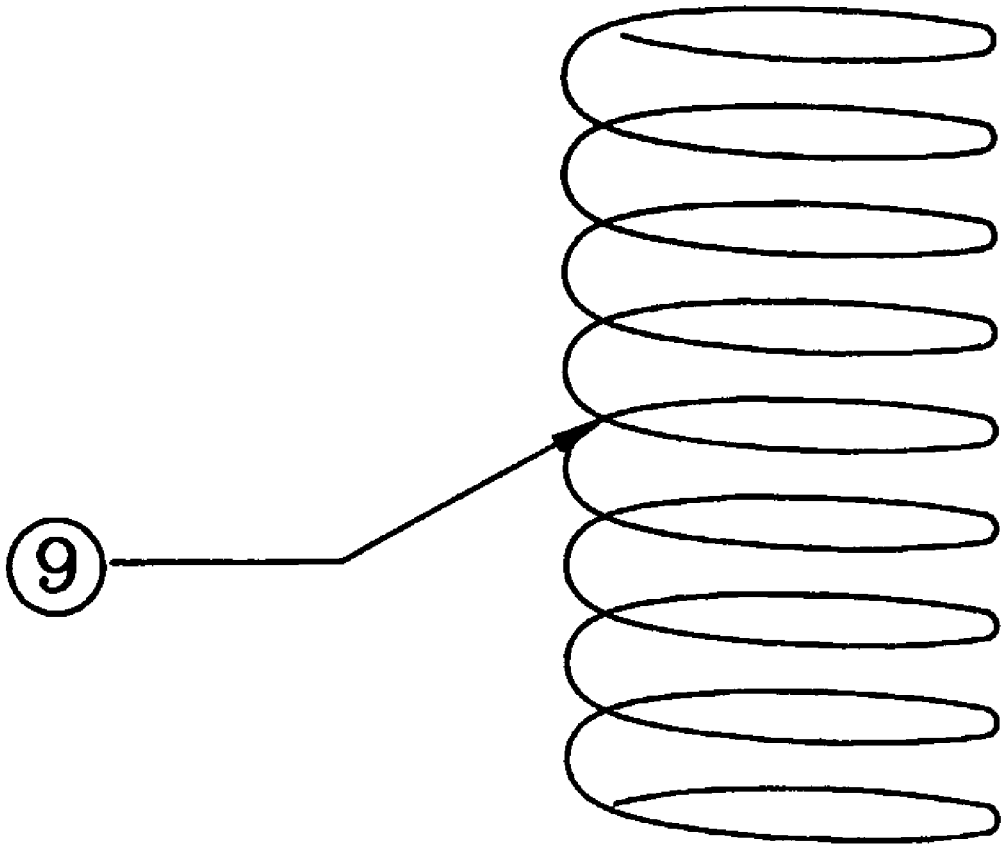
FIG. 12 is spring/biasing mean which will put around the back support to urge against the bell portion of pipe/rod and the outer framing.
Figure 13:
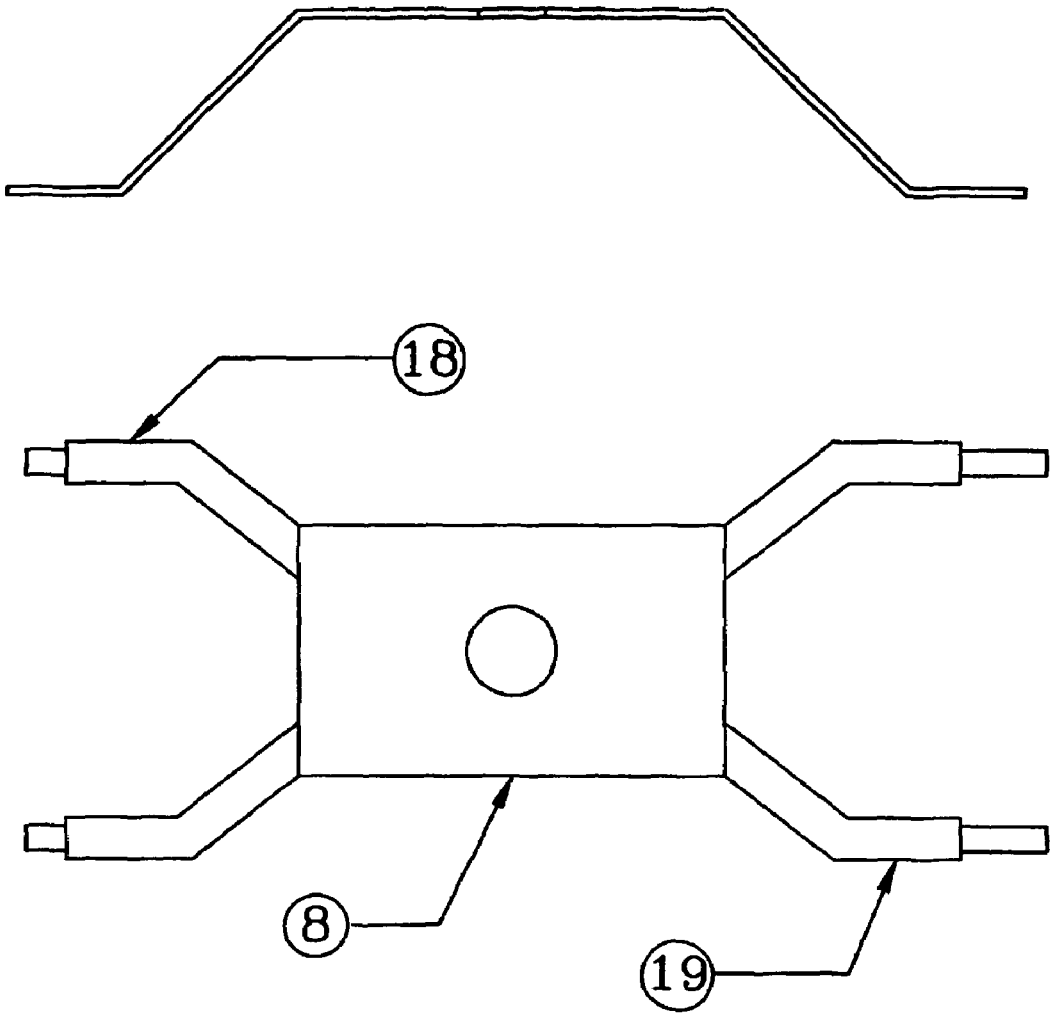
FIG. 13 is the top view of the bracket fitted on the innermost or centre cone, the flat portion of the bracket is welded or brazed or riveted to the back of the inner cone, sometimes with a plate in between for additional strength and the two front legs and two back legs of bell shaped construction at their ends are used to put the spring around the narrow portion so that the spring urges against the bell portion and the outer framing of the intermediate cone placed over to fix intermediate cone over the inner cone.

Referring to FIGS. 2 to 9 the new 3 cone Diffuser consisting of a central cone (1), an intermediate cone (2) and outer cone or outer frame (3) placed one above the other in a space apart relationships having same vertical axis (14) wherein the front central cone (1) made from single piece is attached to the intermediate cone (2) by means of fixing bracket (8) which is welded on the back of the front central cone; the said fixing bracket is welded, brazed or riveted on the back of the central cone. The bracket may be attached to a metal plate, which is attached to the central cone. The bracket (8) is also a single piece made from metal having four legs two at front and two at the back. The back legs are provided with springs (9) the legs are pushed in the grooves of the flanges (17) of the small flat vertical flange (13) on the back of intermediate cone; the front two legs go into the grooves wherein the springs are urging against the flange projected portion thereby the central cone is held in position at the below of the intermediate cone; while dismantling the bracket is pushed back and the spring is compressed therefore the front legs come out of the grooves thereby removing the bracket with central cone from the intermediate cone; the intermediate cone (2) is also made from single piece of metal having central opening (15) with outwardly projected flanges the said flange is provided with two sets of grooves for fixing the central cone bracket and other to sides are welded with pipes/rods (6) with spring wound on the end of two pipes. The said pipes are used to fix the outer frame (3) in the brackets provided (5) four in number engaged in the slots (12) at the inner side of the outer most frame thereby retaining the intermediate cone below the outer cone by means of pipes/rods (6) with biasing means (7) thereby fixing it easily by pushing one sides of the rod into the grooves of the bracket and the other side the pipe goes in the bracket against the spring thereby while dismantling the spring of the pipe is compressed to remove the free end of the pipe from the grooves of the bracket thereby dismantling the intermediate cone from the outer frame.

3 Cone Diffuser comprising a central cone (1), an intermediate cone (2) and outer cone or outer frame (3) placed one above the other in a spaced apart relationships having same vertical axis (14); the said central cone (1) at the back is provided with bracket (8) spot welded or brazed or rivetted to hold the centre cone which is fixed on the intermediate cone in the central opening (15) having outwardly projected flanges (16) having holes/slots (17) to accommodate the front (18) and back (19) support of the bracket, the said back support is provided with springs (9) for easy removal of the bracket, thereby dismantling the central cone easily; the intermediate cone (2) on its outer flanges of the central opening (15) provided with pipe/rod (6) with spring (7) is welded or brazed so as to fix the intermediate cone on the brackets (5) provided in the inner part of the outer cone so as to dismantle the intermediate cone by a slight pressing of the biasing means (7), the said outer cone (3) having central inlet (20) with flanged portion outwardly directed (4) to connect with the ducting or damper; said inlet is adjustable as per the requirement of the ducting; the central cone is further provided with a hole (10) which may be covered by some removable piece to adjust the aperture of the damper.

Accordingly there is provided a new three cone air diffuser comprising as 3 cone diffuser is made up of normally in Steel or Aluminium comprising of a Central Plate or Central Cone, Intermediate Cone and an Outer frame which is fitted with each other by means of at least a pair of spring loaded pipes fitted to each cone and facilitating easy removal of each cone from each other.

The Outer frame (3) made out of a piece of sheet, generally Aluminium or Steel framed with a flanged neck at the centre with variable size to fit different sizes of ducts inlet/outlet, normally circular but can be square or other shape as matching with the duct.

The cone assembly comprising of intermediate cone(s) and central cone fitted with each other by spring loaded assembly.

The Inner cone made up of single sheet attached with a bracket to hold the inner cone fitted by means of welding, spot welding, brazing or rivetting or any other means of fixing purpose of holding the centre cone from the intermediate cone at a particular distance, generally fixed but can be made variable by adjusting the height of the bracket, spring loaded to hold in the place bracket, spring loaded to hold in the same place to make able to remove the assembly when required quickly and easily.

The outer frame (3) of the diffuser has a neck on the backside generally round in shape with a vertical collar (4), which fixes with the opening of the duct. From the vertical collar, the outer extends horizontally and then forming a bell like shape and then having a horizontal flat flange at the earlier edge. The outer edge is generally in square shape but can be blended to form different shapes like square or others. The flat surface of the outer frame containing one or more pairs of projections which can be used as an additional support to the diffuser for fixing to the duct or ceiling. It also comprises at least a pair of slots (12), which are used for fixing brackets (5) for fixing of inner cone assembly.

The intermediate cone is made up of sheet of required size, normally Aluminium of Steel is having an opening, generally square or round at the centre, again a bell shaped structure but with lesser angle than the outer frame and a flat edge at the outer side which is generally of square shape. It contains at least two pairs of slots for fixing of the centre cone to forms the cone assembly.

This is an embodiment of the invention several modifications are possible, which may be considered within the ambit and spirit of this invention. Since any modification, variations and changes in detail may be made to the above described embodiment it is intended that all maters described in the foregoing description and illustration in the accompanying drawing may be considered within the spirit of this invention.

The invention claimed is:

1. A 3-cone diffuser, comprising:

a central cone having a front and a back;

at least an intermediate cone having a front and a back, and a central opening, the intermediate cone having a plurality of flanges arranged adjacent to the central opening;

an outer cone having a front and a back, and a central opening, the outer cone having a plurality of fixing brackets arranged adjacent to the central opening;

a first bracket fastened to the back of said central cone, the first bracket having at least two legs at opposing sides of the central cone and a biasing element disposed at at least one of the legs, the first bracket being arranged to releasably engage with said plurality of flanges for removably attaching said central cone to said intermediate cone; and a second bracket fastened to the back of said intermediate cone, the second bracket having a pair of rods and a biasing element disposed at at least one of the rods, the second bracket being arranged to releasably engage the second bracket with said fixing brackets for removably attaching said intermediate cone to said outer cone;

wherein, in an assembled condition, said central cone, intermediate cone, and outer cone are assembled one above another in a spaced-apart relationship.

2. The diffuser according to claim 1, further comprising an aperture defined and centrally located in said central cone.

3. The diffuser according to claim 1, wherein said first bracket comprises a pair of front legs and a pair of rear legs.

4. The diffuser according to claim 3, wherein said front and rear legs each terminate in an end portion having a narrow end part and a wider inner part.

5. The diffuser according to claim 3, wherein said plurality of flanges comprises a plurality of outwardly projecting flanges formed on the back of said intermediate cone, each of the flanges defining at least one aperture, wherein said front and rear legs engage with the apertures of the outwardly projecting flanges.

6. The diffuser according to claim 5, wherein said biasing element comprises a compression spring disposed on each said rear leg, whereby said bracket is biased for retaining said front legs in engagement with said outwardly projecting flanges.

7. The diffuser according to claim 3, wherein said first bracket further comprises a plate, and front and rear legs are fastened to the plate.

8. The diffuser according to claim 7, further comprising an aperture defined through and centrally located in said plate.

9. The diffuser according to claim 1, wherein each of said rods terminates with an end portion having a narrow outer part and wider inner part.

10. The diffuser according to claim 1, wherein fixing brackets are formed on the front of the outer cone, each of the fixing brackets defining at least one aperture, wherein the ends of said rods engage with the apertures of the fixing brackets.

11. The diffuser according to claim 10, wherein said biasing element comprises a compression spring disposed on one end of each of said rods, whereby opposite ends of said rods are biased into engagement with said fixing brackets.

12. The diffuser according to claim 1, wherein said central cone is formed from a single metal sheet.

13. The diffuser according to claim 1, wherein said intermediate cone is formed from a single metal sheet.

14. The diffuser according to claim 1, wherein said outer cone is formed from a single metal sheet.

* * * * *

UNITED STATES PATENT AND TRADEMARK OFFICE

CERTIFICATE OF CORRECTION

PATENT NO. : 7,662,036 B2
APPLICATION NO. : 10/535847
DATED : February 16, 2010
INVENTOR(S) : Ramesh Nana Mhatre It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1215 days.

Signed and Sealed this

Twenty-eighth Day of December, 2010

David J. Kappos

David J. Kappos
*Director of the United States Patent and Trademark Office*